United States Patent [19]

Kamp

[11] 4,145,867

[45] Mar. 27, 1979

[54] DEVICE FOR RETRANSPORTING A THREAD END OF A TAKE-UP COIL TO THE WITHDRAWAL TUBE OF A ROTOR SPINNING MACHINE

[75] Inventor: Heinz Kamp, Rickelrath, Fed. Rep. of Germany

[73] Assignee: W. Schlafhorst and Co., Monchen-Gladbach, Fed. Rep. of Germany

[21] Appl. No.: 843,247

[22] Filed: Oct. 18, 1977

[30] Foreign Application Priority Data

Oct. 19, 1976 [DE] Fed. Rep. of Germany ..... 2647048

[51] Int. Cl.[2] ..... D01H 15/00; B65H 54/22

[52] U.S. Cl. ..... 57/263; 57/305; 57/58.95; 226/97; 242/35.6 E

[58] Field of Search ..... 57/34 R, 34.5, 58.89–58.95; 226/7, 91, 92, 97; 242/35.6 R, 35.6 E, 35.5 A

[56] References Cited

U.S. PATENT DOCUMENTS

| | | | |
|---|---|---|---|
| 3,077,312 | 2/1963 | Furst | 242/35.6 R |
| 3,131,879 | 5/1964 | Glastra et al. | 242/35.6 E |
| 3,136,494 | 6/1964 | Furst | 242/35.6 R |
| 3,203,634 | 8/1965 | Furst | 242/35.6 E |
| 3,595,493 | 7/1971 | Tsukuma et al. | 242/35.6 R |
| 3,810,352 | 5/1974 | Miyazaki et al. | 57/58.95 X |

*Primary Examiner*—John Petrakes

*Attorney, Agent, or Firm*—Herbert L. Lerner

[57] ABSTRACT

A device for retransporting a thread end of a take-up coil to a withdrawal tube of a spinning machine, includes a two-armed suction tube with a suction nozzle, the suction tube being pivotally mounted and being formed with a bend in a plane wherein it is pivotable, the suction tube having a longitudinally extending slot formed on the inside of the bend for passage of a thread therethrough and into the suction tube under suction, the suction tube having a suction-air flow path extending from the suction nozzle at an end of one of the suction-tube arms through the one suction-tube arm and through the other of the suction-tube arms to the end of the other suction-tube arm and therefrom through an air guidance part to a union for a negative-pressure suction source.

3 Claims, 4 Drawing Figures

16
15
39
11
18
40
38
37
17
19
25
21
33
30
23
20
22
32
24
14
35
25a
34
28
27
26
36
26a
12

DEVICE FOR RETRANSPORTING A THREAD END OF A TAKE-UP COIL TO THE WITHDRAWAL TUBE OF A ROTOR SPINNING MACHINE

The invention relates to a device for retransporting a thread end of a take-up coil to the withdrawal tube of a rotor spinning machine by means of a pivotable, two-armed suction tube having a suction nozzle and being formed with a bend in the plane in which the suction tube is pivotable, the suction tube having a longitudinal slot formed therein at the inside of the bend for passage therethrough of the thread under suction.

To piece or join the broken thread of a rotor spinning machine, the thread end that has already run up on the take-up coil after the thread break must be taken up again rapidly, reliably and as uncomplicatedly as possible and be brought into the vicinity of the withdrawal tube of the rotor spinning machine. Thereat, the thread end, shortened either manually or automatically, can be preprocessed for the joining operation, and introduced into the withdrawal tube for joining anew.

It is an object of the invention to provide a device for retransporting a thread end of a take-up coil to the withdrawal tube of a rotor spinning machine which is both rapid and reliable.

With the foregoing and other objects in view, there is provided, in accordance with the invention, a device for retransporting a thread end of a take-up coil to a withdrawal tube of a spinning machine, comprising a two-armed suction tube with a suction nozzle, the suction tube being pivotally mounted and being formed with a bend in a plane wherein it is pivotable, the suction tube having a longitudinally extending slot formed on the inside of the bend for passage of a thread therethrough and into the suction tube under suction, the suction tube having a suction air flow path extending from the suction nozzle at an end of one of the suction-tube arms through the one suction-tube arm and through the other of the suction-tube arms to the end of the other suction-tube arm and therefrom through an air guidance part to a union for a negative-pressure suction source. Through this invention, assurance is provided that the sucked-in thread will not be transported pneumatically up to the pivot axis of the suction tube as heretofore, but rather up to the end thereof located opposite the suction nozzle. Only from there is further transport effected through a special air guidance part to the union of a negative-pressure suction source of installation. This union can be achieved, for example, over a flexible line so that the pivoting movement of the suction tube, which is required for the transport of the sucked-in thread to the vicinity of the suction tube, is not impeded.

In accordance with another feature of the invention, the suction tube has a pivot axis intermediate the ends thereof, the union for the negative-pressure suction source being at the axis, and the other of the suction-tube arms faces away from the suction nozzle and is divided in longitudinal direction thereof wherein the flow path on the inside of the bend of the longitudinally divided other of the suction-tube arms extends to the end of the other suction-tube arm, and the air guidance part constitutes the flow path on the outside of the bend of the longitudinally divided other of the suction-tube arms and leads to the union for the negative-pressure suction source.

When using the invention, the thread is always held fast in tension at the end of the suction tube facing or extending away from the suction nozzle and can be seized by the clamping and severing means after pivoting of the suction tube, by means of which this suction-tube end is brought into the vicinity of the withdrawal tube of the rotor spinning machine, and can be cut to length. These clamping and severing means are fastened either to the respective spinning station of the spinning machine or to the suction tube per se.

The hereinafore mentioned actions can be carried out fully automatically for which purpose, for example, a program switching mechanism of conventional construction can be employed.

An advantage derived from the invention of the instant application is especially that the thread, solely due to the bent suction tube, is brought into the vicinity of the withdrawal tube and transferred thereat to a clamping and severing device. Mechanical means for transporting the thread to this clamping and severing device are not required.

Other features which are considered as characteristic for the invention are set forth in the appended claims.

Although the invention is illustrated and described herein as embodied in a device for retransporting a thread end of a take-up coil to the withdrawal tube of a rotor spinning machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
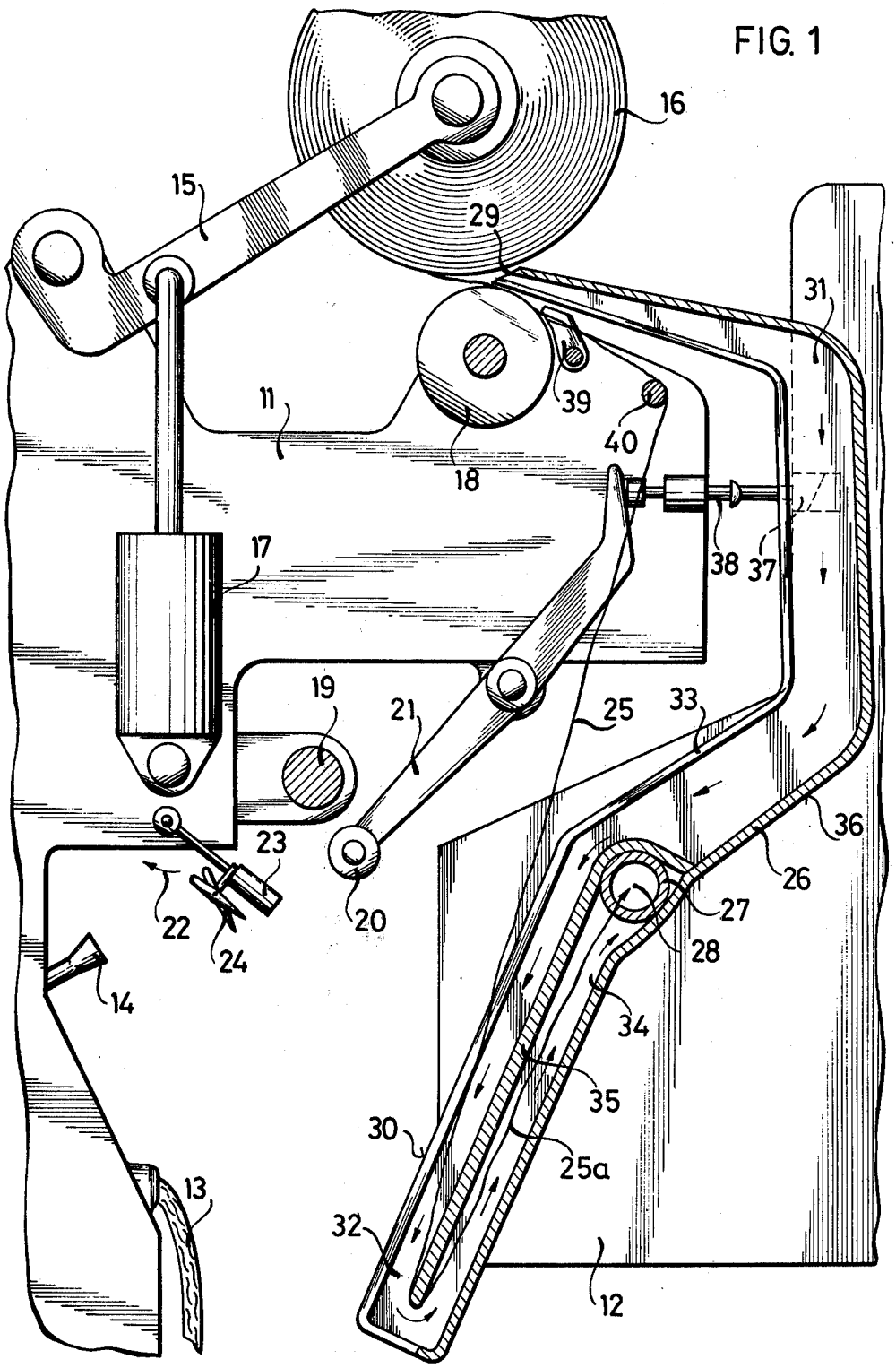
FIG. 1 is a simplified diagrammatic side elevational view, partly in section of an assembly of an individual spinning station of a rotary spinning machine with a thread piecing or joining device disposed in front thereof and having connected therewith a device according to the invention for retransporting the thread end of a take-up coil to the withdrawal tube of the rotor spinning machine.
Figure 2:
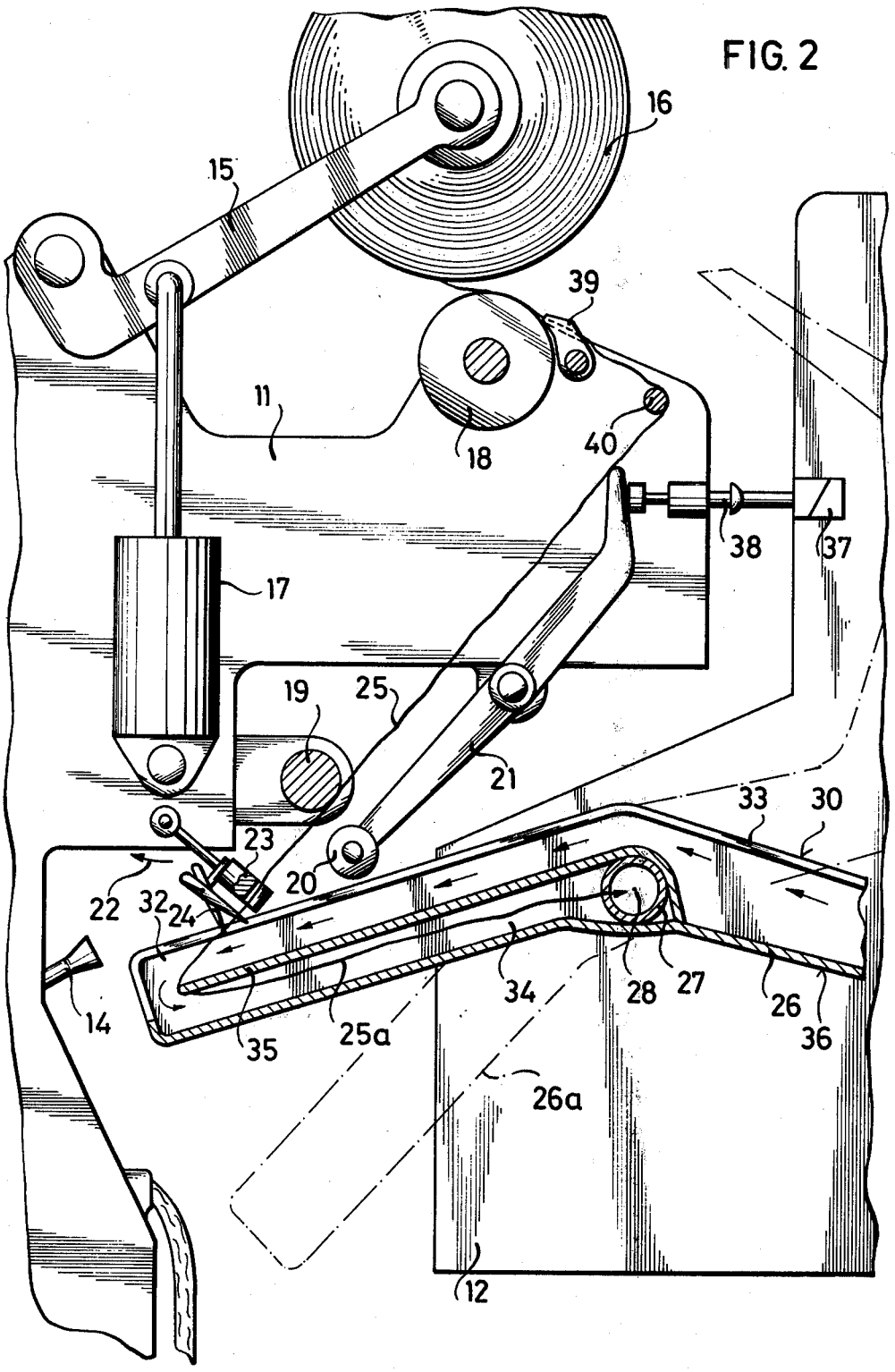
FIG. 2 is another view of FIG. 1 showing the assembly in a different phase of the operation thereof wherein the withdrawal or suction tube is in outwardly swung condition during transfer of the thread to a clamping and severing device.

Referring now to the drawing and, first, particularly to FIGS. 1 and 2 thereof, there is shown a spinning station 11 of an otherwise non-illustrated rotor spinning machine. In front thereof, a thread piecing or joining device is stationed and is, in fact, active at the spinning station 11. A sliver 13 is running into the spinning station 11, and a withdrawal tube 14 is also provided at the spinning station 11 for the spun thread which is, however, not present at this spinning station 11, because a thread break has occurred beforehand thereat. In the upper part of the spinning station 11, a coil holder 15 is articulatingly fastened and carries a take-up coil 16. The coil holder 15 has, in fact, been raised so high by a conventional coil lifter 17 that the take-up coil 16 has been lifted somewhat away from a continuously rotating drive roller 18. In a middle part of the spinning station 11, as viewed in FIGS. 1 and 2, there is a continuously rotating withdrawal roller 19 and a pressure roller 20 which can be pressed against the withdrawal roller 19 for the purpose of withdrawing the thread. Above the withdrawal tube 14, a clamping device 23 having joined thereto a severing device 24 for the thread 25 is mounted for pivotal movement in direction of the arrow 22. Alternatively, the clamping device 23 and the severing device 24 can also be fastened to the suction tube 26 of the invention which is mounted on the thread joining device 12.

As shown in sectional view in FIG. 1, the suction tube 26 mounted on the joining device 12 has a connecting piece or union 27 for an otherwise non-illustrated negative pressure-producing suction plant or installation. The suction tube 26 is pivotable about an axis 28 which is also simultaneously the central axis of the union 27. A suction nozzle 29 is located at the upper end of the suction tube 26, as viewed in FIG. 1. The suction tube 26 is bent in the plane in which it is pivotable as is clearly seen in FIG. 1. That is to say, the bend of the suction tube 26 is along the plane of the paper, perpendicular to the axis 28. The inside 30 of the bend is directed toward the spinning station 11 and is formed with a continuous slot 33 extending from the suction nozzle 29 along the suction-tube arm 31 connected thereto down to the end of a suction tube arm 32 facing away from the suction tube 29, the previously sucked-in thread 25 having a thread end **25*a* passing through the continuous slot 33**.

A separate air guidance part 34 is formed by the division of the suction-tube arm 32 due to a partition 35 so that the air flow direction indicated by the small arrows is along the suction tube 26 to the end of the suction-tube arm 32 at the inside 30 of the bend of the suction tube 26 and then in counterflow at the outside 36 of the bend within the air guidance part 34 to the union or connecting piece 27.

By means of an electromagnetic drive 37 of the joining device 12, a plunger or armature 38 at the spinning station 11 is forced against a pivot lever 21 so as to pivot the latter and accordingly lift the pressure roller 20 away from the withdrawal roller 19.

After sucking-in and tensioning the thread 25, the suction tube 26 is pivoted clockwise about the axis 28, and the thread 25 assumes the position thereof shown in FIG. 2. The thread 25 is thus brought into the vicinity of the clamping device 23 and the severing device 24. The instant the thread 25 is clamped by the clamping device 23, the severing device 24 becomes actuated, severs the thread 25, forming a new thread end, which can be brought in front of the withdrawal tube 14 by pivoting the clamping device 23 in direction of the arrow 22. The old, severed thread end **25*a* is sucked into the connecting piece or union 27**.

After the suction tube 26 has swung back into the starting position thereof represented in FIG. 2 by the dot-dash lines and identified as **26*a*, the joining action produced by sucking the thread end into the withdrawal tube 14, tying the thread end to the fiber ring of the rotor and beginning the thread withdrawal after the electromatnetic drive 37** has been switched off can then be carried out.

Figure 3:
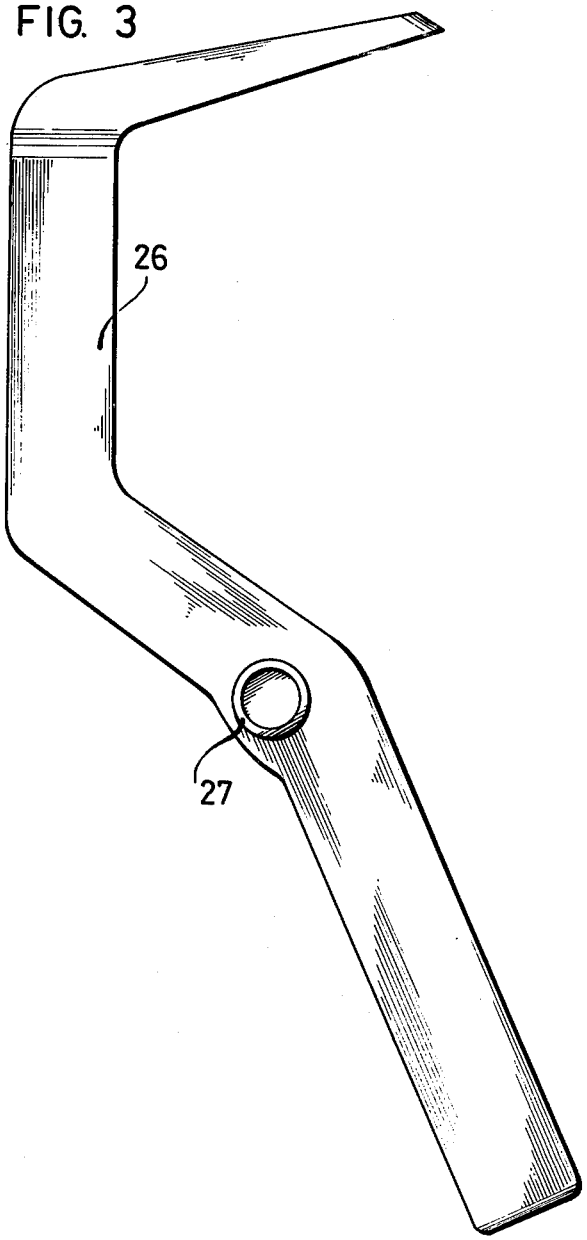
FIG. 3 is an enlarged side elevational view of the device for transporting the thread end to the withdrawal tube.
Figure 4:
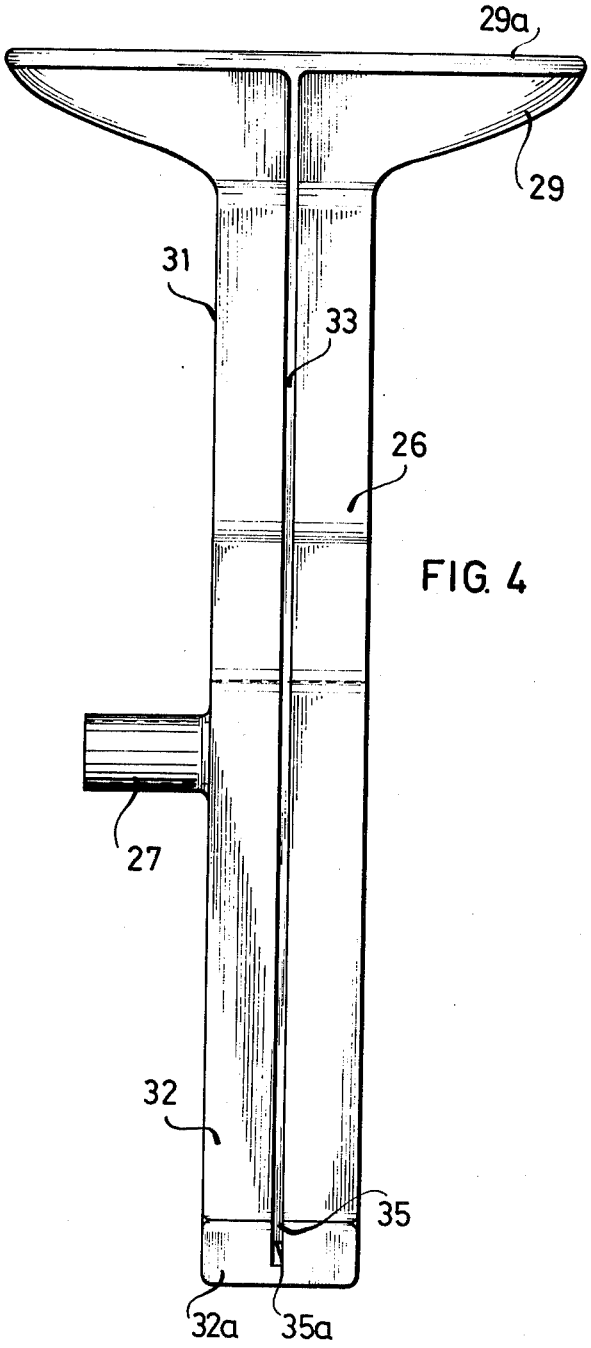
FIG. 4 is a view of FIG. 3 from the right-hand side thereof showing the slot formed therein.

From FIGS. 3 and 4, the exact shape of the suction tube 26 is readily apparent. Especially shown in FIG. 4 is how the suction arm 31 merges into the suction nozzle 29, and the continuous slot 33 terminates only at the end **32*a* of the suction-tube arm 32. In FIG. 4, the partition or intermediate wall 35 is partly visible through the slot 33. The termination or mouth 29*a* of the suction nozzle 29 extends over the entire width of the take-up coil 16. To suck in, the mouth 29*a* is disposed tightly against the surface of the take-up coil 16. The thread end is thus initially sucked into the suction nozzle 29. Then, the thread end runs the course of the suction-tube arm 31 and thereafter, the course of the suction-tube arm 32 until the end thereof. The thread end then passes around the lower edge 35*a* of the partition 35 and finally reaches into the air guidance part 34 which is no longer visible in FIG. 4. At the latest when the threaded end has reached the air guidance part 34, the thread 25 leaves the slot 33, in its strivings to reach the region of greatest negative pressure along the shortest possible path, accordingly slips into the thread guide 39 and engages the guide wire 40 (FIGS. 1 and 2). Until it is clamped by the clamping device 23, the thread 25 remains thus outside the upper part of the slot 33**.

I claim:

1. A device for retransporting a thread end of a take-up coil to a withdrawal tube of a rotor spinning machine, comprising a two-armed suction tube with a suction nozzle, said suction tube being pivotally mounted about an axis and being formed with a bend having an inside, said suction tube having a longitudinal slot formed on the inside of the bend extending through both suction-tube arms for passage of a thread therethrough and into said suction tube under suction, said suction tube having a suction-air flow path extending from said suction nozzle at an end of one of said suction-tube arms through said one suction-tube arm and through the other of said suction-tube arms to the end of said other suction-tube arm and therefrom through an air guidance part to a union for a negative-pressure suction source, said union having an axis which is coextensive with said pivot axis.

2. Device according to claim 1 wherein said pivot axis is intermediate the ends of said suction tube, and wherein said other of said suction-tube arms faces away from said suction nozzle and is divided in longitudinal direction thereof wherein said flow path on the inside of said bend of said longitudinally divided other of said suction-tube arms extends to the end of said other suction-tube arm, and said air guidance part constitutes the flow path on the outside of said bend of said longitudinally divided other of said suction-tube arms and leads to said union for said negative-pressure suction source.

3. Device according to claim 2, wherein the end of said other suction-tube arm conducts the thread to the withdrawal tube upon pivoting of said suction tube.

* * * * *